United States Patent [19]

Lee

[11] Patent Number: 4,789,355

[45] Date of Patent: Dec. 6, 1988

[54] ELECTRICAL COMPRESSION CONNECTOR

[76] Inventor: Noel Lee, 47 West Park Dr., Daly City, Calif. 94015

[21] Appl. No.: 42,322

[22] Filed: Apr. 24, 1987

[51] Int. Cl.[4] ..... H01R 17/18

[52] U.S. Cl. ..... 439/584; 439/309; 439/775

[58] Field of Search ..... 439/806, 807, 578–585, 439/675, 299, 347, 350, 351, 352, 370, 783, 786, 816, 821, 833, 835, 836, 784, 805, 308–310, 349, 372, 775

[56] References Cited

U.S. PATENT DOCUMENTS

| | | | |
|---|---|---|---|
| 3,325,767 | 6/1967 | Lancaster | 439/578 |
| 3,452,323 | 6/1969 | Bowley et al. | 439/578 |
| 4,045,113 | 8/1977 | Iacono | 439/578 |
| 4,155,619 | 5/1979 | Bray et al. | 439/578 |

FOREIGN PATENT DOCUMENTS

| | | | |
|---|---|---|---|
| 0094937 | 6/1922 | Switzerland | 439/805 |

*Primary Examiner*—David Pirlot
*Attorney, Agent, or Firm*—Warren B. Kice

[57] ABSTRACT

An electrical connector for connecting to a jack having a socket and a rim and including a cylindrical hollow body having a pin and a flared contact member projecting from one end thereof for engaging the socket and the rim respectively. An outer sleeve extends around the body member and is adapted for slidable movement relative to the body member and contact member for compressing the contact member inwardly into engagement with the rim.

7 Claims, 1 Drawing Sheet

ELECTRICAL COMPRESSION CONNECTOR

BACKGROUND OF THE INVENTION

This invention relates to a connector, a more particularly to an electrical connector for establishing an electrical and mechanical connection to a jack.

Various electronic components require an external electrical conductor to be connected to a component, usually via a female jack formed on the component. Thus, several types of electrical connectors have been devised which are connected to the conductor and are adapted to be inserted or otherwise fitted to a female jack on the component to effect a mechanical connection with the jack and an electrical connection between the conductor and circuitry electrically connected to the jack.

One of the most popular type connectors of this type is termed an "RCA plug" which features a pin and an outer rim which receives the electrical conductor and which connects to a socket and an inner rim, respectively, of a complementary jack. The outer rim of the RCA plug is constructed and arranged to extend over the rim of the jack in a engaging relationship. However, upon repeated use, the outer rim becomes bent outwardly, which compromises the mechanical and electrical connection between it and the corresponding rim of the jack.

SUMMARY OF THE INVENTION

It is therefore an object of the present invention to provide an electrical connector which effects a secure and stable mechanical and electrical connection with a corresponding jack.

It is another object of the present invention to provide and electrical connector of the above type in which a flared contact sleeve is provided which extends around the rim of the jack and which is compressed inwardly into a positive contact with the rim of the jack to effect a stable and secure mechanical and electrical connection.

Toward the fulfillment of these and other objects, the connector of the present invention includes a pin and a flared contact sleeve projecting outwardly from a body member and adapted to engage a socket and a rim, respectively, of a corresponding jack. A sleeve is slidable over the body member into an engagement with the contact sleeve to compress the latter into a secure and stable mechanical and electrical connection with the rim of the jack.

BRIEF DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in conjunction with the accompanying drawing and depicting the apparatus of the present invention.

DESCRIPTION OF THE PREFERRED EMBODIMENTS

Figure 1:
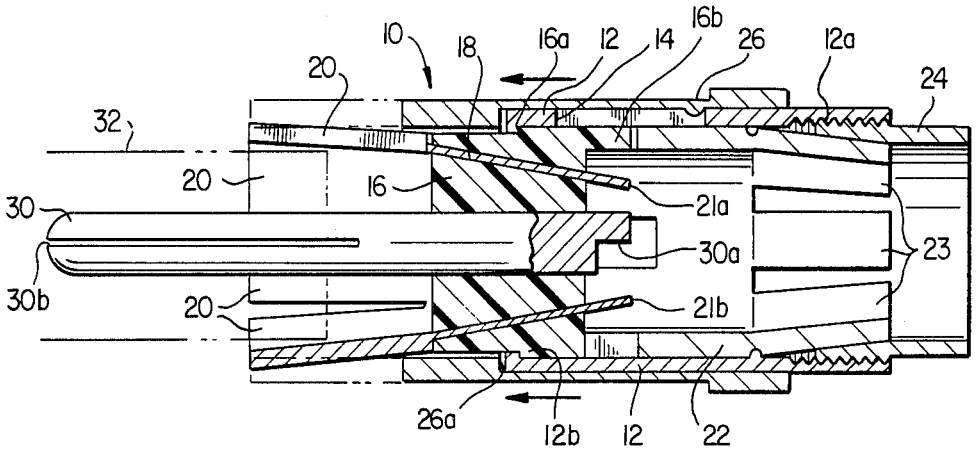
FIG. 1 is a cross-sectional view of the connector of the present invention shown in an engaging relationship with a corresponding jack.

Referring to FIG. 1 of the drawings, the reference to numeral 10 refers, in general, to the connector of the present invention which consists of a cylindrical body member 12 one end portion of which is internally threaded, as shown by the reference numeral 12*a*, and the other end portion of which has an inner shoulder 12*b* formed thereon. A longitudinal slot 14 is formed in the body member 12 between the end portions thereof for reasons to be described.

A plastic support member 16 partially extends within one end portion of the body member 12. The outer diameter of the support member 16 is slightly less than the inner diameter of the body member 12 so that it fits snugly within the body member in a frictional type fit. The outer surface of the support member 16 is stepped to form a shoulder 16*a* which engages the shoulder 12*b* of the body member 12 to locate the support member 16 relative to the body member.

A frustoconcial sleeve 18 is embedded in the support member 16 and has a plurality of flared contact leaves 20 formed integrally therewith and projecting outwardly from one end thereof. The leaves 20 together form a flared sleeve, or frustocone, extending coaxially with the body member 12 and having a diameter increasing in a direction extending from the sleeve 18. A pair of extensions, or terminals, 21*a* and 21*b* extend from the other end of the sleeve 18 and project outwardly from the support member 16 and into the interior of the body member 12.

A plurality of tabs 16*b* extend around the inner end of the support member 16 and mate with corresponding tabs (not shown) formed on an inner sleeve 22 also disposed within the body member 12 and extending coextensive with the tabs 16*b*, so that the inner sleeve is axially aligned with the support member.

A plurality of leaves 23 are formed integrally with, and extend from, the free end portion of the inner sleeve 22 and are compressed radially inwardly by a compression nut 24 which extends within the interior of the threaded end portion 12*a* of the body member 12 in threaded engaged therewith. The dimensions of the inner sleeve 22, the body member 12, and the nut 24 are such that, upon rotation of the nut and axial advancement of the nut into the interior of the body member, the leaves 23 are compressed radially inwardly for reasons that will be explained.

An outer sleeve 26 extends over the body member 12 and has an inner diameter slightly greater than the outer diameter of the body member to permit slidable movement of the sleeve relative to the body member. One end portion of the sleeve 26 is stepped to form an inner shoulder 26*a* which normally engages the end of the body member 12. A tab 26*b* is formed on the inner wall of the sleeve 26 and extends in the slot 14 of the body member 12 to limit the slidable movement of the sleeve relative to the body member 12. The inner diameter of the sleeve 26 is less than that of the diameter of the free end portion of the frustocone defined by the leaves 20 so that, during movement of the sleeve 26 in a direction from right-to-left as shown by the arrows in FIG. 1 to the position shown by the dashed lines, the left end portion of the sleeve 26 exerts a radially inwardly directed compressive action against the flared leaves 20 to compress them radially inwardly for reasons to be described.

A contact pin 30 is provided which extends coaxially with the body member 12 and the frustocone formed by the leaves 20, and has a portion extending through a bore in the support member 16 in a friction fit. One end portion of the pin 30 projects outwardly from one end of the support member 16 within the interior of the body member 12 and is notched as shown by the reference numeral 30*a*. The other end portion of the pin projects outwardly from the other end of the support member 16 and is notched as shown by the reference numeral 30*b* to facilitate its insertion within a complementary opening, or socket (not shown), formed in a jack as will be described.

The pin 30 is adapted to be connected to an electrical conductor (not shown) by connecting the positive lead of the conductor to the notched portion 30*a* of the pin and the negative lead of the conductor to one of the terminals 21*a* or 21*b*. These connections can be made in any known manner such as by soldering. After these connections have been established, the nut 24 is advanced relative to the body member 12 in a direction from right-to-left as viewed in FIG. 1 to compress the leaves 23 against the conductor and thus secure the latter relative to the body member 12.

The connector 10 is designed to establish an electrical connection between a "female" jack and the conductor connected to the terminals 21*a* or 21*b* and the notched portion 30*a* of the pin 30. The outer rim of the jack is shown by the reference numeral 32, and to establish the connection, the connector 10 is advanced in a direction from right-to-left towards the jack until the leaves 20 extend over, and in engagement with, the rim 32 of the jack. This establishes a "ground" connection between the negative lead of the conductor connected to the terminals 21*a* and 21*b* and a corresponding conductor or component connected to the jack. The connector 10 is then advanced further in the right-to-left direction until the pin 30 extends fully within a corresponding socket (not shown) defined by the jack to establish the positive connection between the positive lead of the conductor connected to the notched portion 30*a* of the pin 30 and a corresponding conductor or component connected to the jack.

The outer sleeve 26 is then manually advanced in a right-to-left direction to engage and compress the flared leaves 20 radially inwardly against the rim 32. This advancement continues until the above compression is maximized and the connector 10 is thus positively secured to the jack.

It is thus seen that the connector 10 of the present invention provides a stable and secure mechanical and electrical connection between its conductor and the jack and eliminates the possibility of the leaves 20 bending outwardly to compromise the quality of the connection. Also, the connector 10 can easily be disconnected from the jack by retracting the sleeve 26 in a left-to-right direction to release the engagement with the rim 32 and then moving the body member 12 in the same direction until the pin 30 is removed from the socket and the leaves 20 are moved out of engagement with the rim 32.

It is also noted that, according to the present invention, the ground connection established between the contact sleeve 16 and the rim 32 is established initially before the positive connection between the rim 30 and the corresponding socket, and, upon withdrawal of the connector 10 from the jack, the ground connection is broken last.

Figure 2:
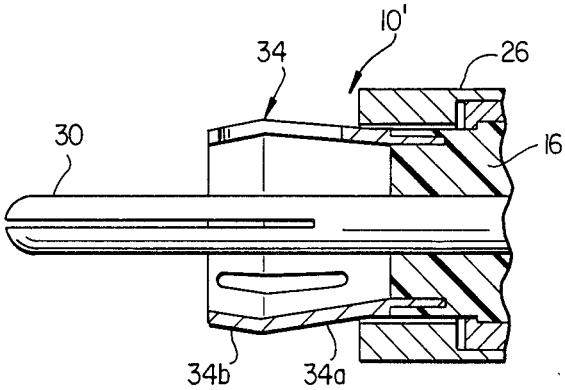
FIG. 2 is a partial view similar to FIG. 1, but depicting an alternate embodiment of the connector of the present invention.

The embodiment of FIG. 2 is similar to that of FIG. 1 and therefore the same components are given identical reference numerals. According to the embodiment of FIG. 2, a connector 10' is provided which includes a contact sleeve 34 which has an outwardly flared portion 34*a* and an inwardly tapered end portion 34*b*. Thus the sleeve 26, when advanced in a right-to-left direction, compresses the flared portion 34*a* inwardly which urges the tapered portion 34*b* into a positive engagement with the rim of the jack. Otherwise the connector 10' of FIG. 2 is identical to the connector of FIG. 1.

Figure 3:
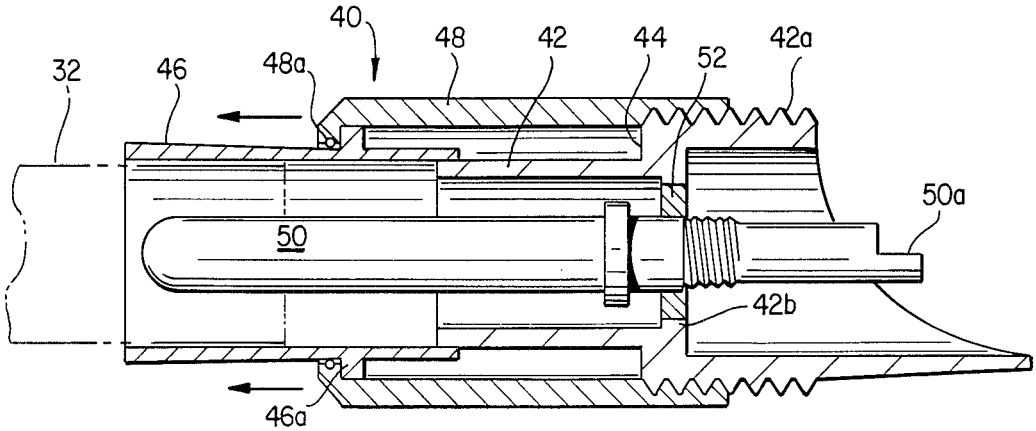
FIG. 3 is a view similar to FIG. 1, but depicting another alternative embodiment of the connector of the present invention.

According to the embodiment of FIG. 3, a connector 40 is provided which consists of a cylindrical body member 42 having a stepped outer surface to form an annular shoulder 44. A contact sleeve 46 has an end portion extending within an outer sleeve 48 and over an end portion of the body member 42. The remaining portion of the sleeve 46 projects from the sleeve 48 and is flared outwardly as shown. The portion of the sleeve 46 extending within the sleeve 48 has an annular flange, 46*a* extending outwardly therefrom which normally engages an inwardly directed flange 48*a* formed on the corresponding end of the sleeve 48.

The other end portion of the sleeve 48 has an internally threaded bore in engagement with a corresponding threaded outer surface 42*a* formed on the body member 42. Thus, by rotating the sleeve 48 relative to the body member 42 the sleeve moves in an axial direction relative to the body member. During this movement in a right-to-left direction, the flange 48*a* of the sleeve 48 exerts a radially inwardly-directed compressive action against the flared end portion of the sleeve 46.

A contact pin 50 is provided which has a portion extending through a ring 52 secured in the body member 42. The ring 52 is fitted within an annular flange 42*b* extending from the inner surface of the body member 42. One end portion of the pin 50 projects outwardly from the ring and is notched as shown by the reference numeral 50*a*. The remaining portion of the pin 50 extends through the interior of the sleeve 46.

The pin 50 is adapted to be connected to an electrical conductor (not shown) by connecting the positive lead of the conductor to the notched portion 50*a* of the pin and the negative lead of the conductor to an internal surface of the body member 42.

The operation of the connector 40 is identical to that of the connector 10 of the embodiment of FIG. 1 with the exception that the sleeve 48 is advanced relative to the body member 42 by rotating the former relative to the latter. Thus the embodiment of FIG. 3 enjoys all of the advantages of the connector 10 of the previous embodiment.

It is understood that several variations may be made in the foregoing without departing from the scope of the invention. For example, the leaves 20 do not have to be flared, but can be sized to define an inner diameter that receives the rim 32 with minimum clearance or so that they are forced slightly radially outwardly upon insertion of the rim therein.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A connector for connecting to a jack having a socket and a rim, said connector comprising a cylindrical hollow body member; a pin projecting from one end of said body member for engaging said socket upon advancement of said connector in a direction towards said jack; a plurality of flared leaves projecting from said end of said body member and having a generally frustoconical shape with the maximum inner diameter of the frustocone being formed at free ends of said leaves and being greater than the outer diameter of said rim, so that, upon said advancement of said connector in said direction, said rim extends within said flared leaves, the minimum inner diameter of said frustocone being less than the outer diameter of said rim so that said flared leaves engage said rim; and an outer sleeve having a first portion slidably mounted on said body member and adapted for slidable movement relative to said body member, and a second portion extending around said frustocone in engagement therewith, said second portion having a constant inner diameter along its length which is less than the maximum outer diameter of said frustocone so as to compress said contact member into engagement with said rim upon said advancement of said outer sleeve in said direction.

2. The connector of claim 1 further comprising a support member extending within said body member in a friction fit and having a central bore for supporting said pin.

3. The connector of claim 1 wherein said pin and said frustocone extend in a coaxial relationship to said body member.

4. The connector of claim 1 wherein said outer sleeve and said body member are provided with cooperating threads so that rotation of said outer sleeve causes said slidable movement.

5. The connector of claim 1 wherein an electrical conductor is receivable with the exterior of said body member, said pin and said contact member being connectable to positive and negative leads, respectively, of said electrical conductor.

6. The connector of claim 5 further comprising means disposed within said body member for clamping said electrical conductor.

7. The connector of claim 6 wherein said clamping means comprises an inner sleeve disposed in said body member and having an inwardly tapered end portion and a compression nut threadedly connected to said body member and adapted to compress said inner sleeve radially inwardly against said conductor.

* * * * *